166-66

5/24/83 OR 4,384,612

United States Patent [19]

Bradford et al.

[11] 4,384,612

[45] May 24, 1983

[54] BLOWOUT PREVENTER CONTROL APPARATUS

[75] Inventors: Jack Bradford, Ft. Stockton; William S. Manuel, Houston, both of Tex.

[73] Assignee: Canamco, Inc., Houston, Tex.

[21] Appl. No.: 299,832

[22] Filed: Sep. 8, 1981

[51] Int. Cl.[3] ..... E21B 44/00

[52] U.S. Cl. ..... 166/66; 137/554; 166/53

[58] Field of Search ..... 166/66, 65 R, 113, 53; 137/552–554; 175/24–27

[56] References Cited

U.S. PATENT DOCUMENTS 4,215,746 8/1980 Hallden et al. ..... 166/53

4,337,653 7/1982 Chauffe ..... 166/53 X

*Primary Examiner*—Stephen J. Novosad

*Assistant Examiner*—Thuy M. Bui

*Attorney, Agent, or Firm*—Bill B. Berryhill

[57] ABSTRACT

Control apparatus for preventing inadvertent operation of the drawworks of a drilling rig upon closure of an associated blowout preventer, the drawworks being at least partially operated by air from an air source connected thereto by an air conduit. The control apparatus may comprise control components for connection to the air conduit and movable from a first mode, in which air is permitted to communicate with the drawworks through the air conduit, and a second mode, in which air is prevented from communicating with the drawworks. Also included are monitor components for connection to the blowout preventer and the control components for sensing whether the blowout preventer is in opened or closed positions and initiating movement of the control components to the second mode upon movement of the blowout preventer to the closed position.

30 Claims, 4 Drawing Figures

BLOWOUT PREVENTER CONTROL APPARATUS

BACKGROUND OF THE INVENTION

1. Field of the Invention

The present invention pertains to blowout preventer control apparatus. Specifically, the present invention pertains to control apparatus suitable for preventing inadvertent operation of the drawworks of the drilling rig upon closure of an associated blowout preventer, the drawworks being at least partially operated by air.

2. Brief Description of the Prior Art

Since the early days of the petroleum industry, "blowout" of a well during drilling operations has been a major concern. If the proper precautions are not taken, the drill bit may enter a high pressure formation forcing oil and/or gas to rush out of the well creating hazards to both life and property. Since the late nineteenth century, various types of flow control devices have been developed to prevent such blowouts. These flow control devices, known in the industry as blowout preventers, may be classified under one of three broad types: the inverted packer type; the ram type; and the stuffing box or pressure operated drilling packer type. The purpose of any of these types of blowout preventers is to seal the annular space between the drill stem and the casing quickly, easily and safely.

One of the most popular and widely used of these three types of blowout preventers is the ram type. Such preventers generally comprise a housing which may be attached to the well casing and which is provided with a passageway through which the drill pipe may be passed. Carried in the housing is a pair of rams which are disposed for reciprocal movement between a retracted or open position, in which the annular area between the drill string and the blowout preventer passageway is open, and an extended or closed position, in which the rams engage the exterior of the drill string and sealingly close the annular space between the drill string and casing. The rams are usually connected by a rod to a piston and cylinder assembly carried by the blowout preventer housing. To close the blowout preventer, hydraulic pressure is applied to the piston and cylinder assembly, forcing the rams into sealing engagement with the drill string. To open the blowout preventers, pressure is simply applied to the opposite end of the piston and cylinder assembly. Such pressures are normally provided by manual manipulation of a hydraulic control mechanism.

Drilling rigs are also provided with drawworks which among other things is used to raise and lower the drill string. Most modern day drawworks are provided with an air operated clutch assembly to which air is supplied by an air source, commonly referred to as "rig air".

If the ram-type blowout preventer has been closed and the drawworks are inadvertently engaged to lift the drill string, damage may occur to the rig or the drill string. In fact, it may cause the drill string to be severed, dropping thousands of feet of drill string in the well hole. This may require an extremely costly "fishing" operation and in some cases even require that the hole be abandoned. Recognizing the extreme cost of the present day drilling for oil and/or gas, it is easily seen that such inadvertent operation of the drawworks should be prevented if at all possible.

SUMMARY OF THE PRESENT INVENTION

In the present invention, control apparatus is provided for preventing inadvertent operation of the drawworks of a drilling rig upon closure of an associated blowout preventer. The invention is contemplated for use with drawworks which are at least partially operated by air from an air source (rig air) connected thereto. Briefly stated, the control apparatus comprises: a control assembly for connection to an air conduit and movable from a first mode, in which air is permitted to communicate with the drawworks through the air conduit and a second mode, in which air is prevented from communicating with the drawworks; and a monitor assembly for connection with the blowout preventer and the control assembly for sensing whether the blowout preventer is in the opened or closed position and initiating movement of the control assembly to the second mode upon movement of the blowout preventer to the closed position.

In one embodiment of the invention, the control assembly includes an air-operated control valve for connection in the air conduit and movable, in response to air supplied thereto, from an open position, in which air is permitted to communicate with the drawworks through the air conduit, to a closed position, in which air is prevented from communicating with the drawworks. The control assembly also includes an operating valve having its inlet connected to the air source upstream of the control valve and at least one outlet connected to the control valve for supplying operating air thereto upon receipt of a signal indicating the blowout preventer is in its closed position.

The monitor assembly for sensing whether the blowout preventer is opened or closed includes apparatus which is responsive to closing pressure applied to the blowout preventer to provide the signal to the operating valve by which operating air is supplied to the control valve for preventing air from being communicated to the drawworks. Thus, when the blowout preventers are closed, air is prevented from communicating with the drawworks, preventing inadvertent operation thereof and the consequent damage to the rig or drill string.

Even though inadvertent operation of the drawworks is to be prevented when the blowout preventers are closed, there are some circumstances where operation of the drawworks is desired. For example, the operator of the drilling rig may want to "strip" the drill string through the blowout preventers while maintaining pressure control of the well. To permit such, the control apparatus of the present invention may be provided with an override device, operable independently of the monitor assembly, for supplying operating air to the control valve regardless of the position of the blowout preventer.

Thus, the control apparatus of the present invention is effective in preventing inadvertent operation of the drawworks of a drilling rig upon closure of an associated blowout preventer by interrupting air to the drawworks. However, in some embodiments of the invention, controlled operation of the drawworks is permitted, even when the blowout preventers are closed, by providing an override device. Annunciators are provided for indicating the position of the blowout preventer and whether or not air is being supplied to the control valve and the drawworks.

The control apparatus of the present invention is extremely efficient, safe and economical. It can be easily installed and serviced in the field. Other objects and advantages of the invention will be apparent from reading the description which follows in conjunction with the accompanying drawing.

DESCRIPTION OF A PREFERRED EMBODIMENT

Figure 1:
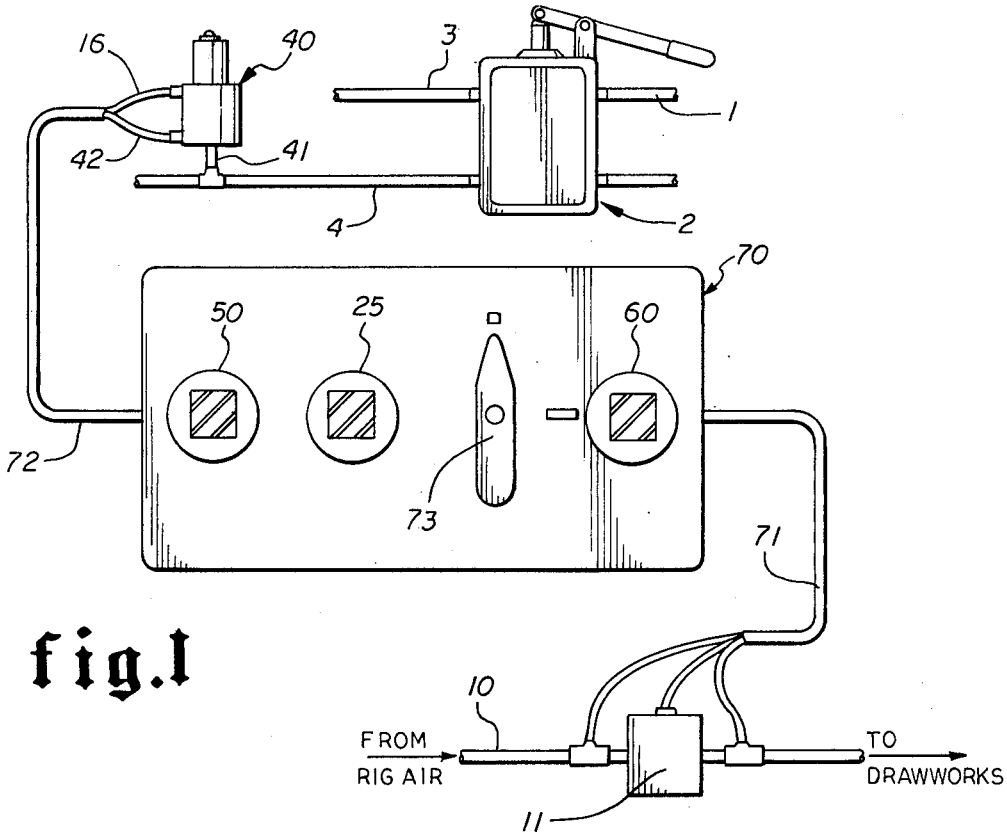
FIG. 1 is a pictorial illustration of a pneumatic version of the control apparatus of the present invention, according to a preferred embodiment thereof.
Figure 2:
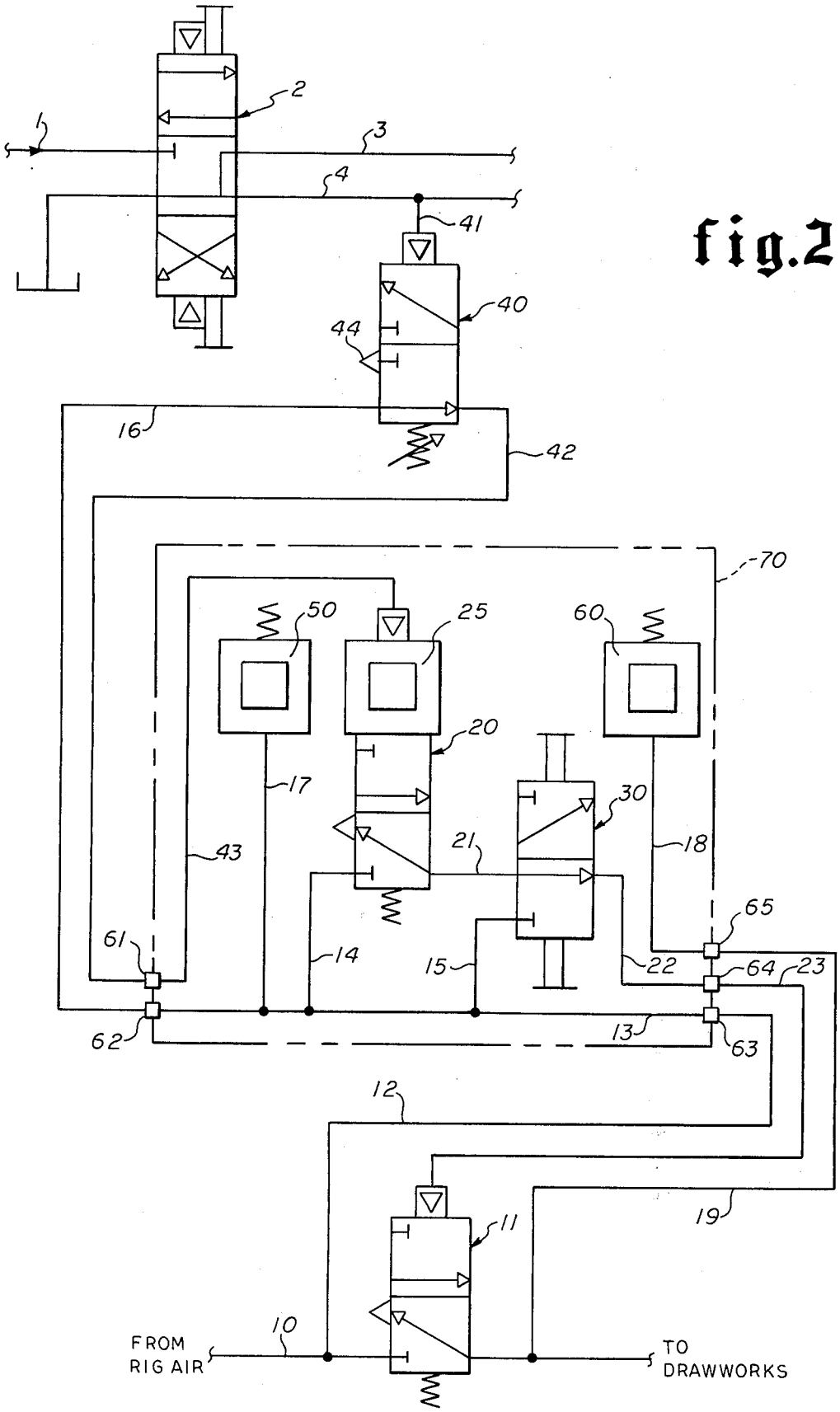
FIG. 2 is a pneumatic circuit representation of the control apparatus of FIG. 1.

Referring first to FIGS. 1 and 2, a pneumatic version of the control apparatus of the present invention will be described. From a visual viewpoint, the control apparatus will appear as in FIG. 1. However, for description of the operation of the control apparatus, reference will be made to FIG. 2.

The control apparatus will be described for use in conjunction with blowout preventers (BOP) (not shown) associated with a drilling rig, the drawworks of which is supplied from a source of air (rig air) through an air conduit 10. Actually the air conduit 10 is connected to the clutch controls of the drawworks (not shown). Installed in the air conduit 10 is an air operated control valve 11 movable in response to air supplied thereto, from an open position, in which air is permitted to communicate with the drawworks clutch controls, to a closed position, in which air is prevented from communicating with the drawworks clutch controls.

The blowout preventer (BOP) is connected to a pressurized hydraulic fluid supply 1 through a blowout preventer control 2 and conduits 3 and 4. With the blowout preventer control 2 in one position, fluid is supplied through conduit 3 to one side of the blowout preventer rams for opening the preventer. With the blowout preventer control in the opposite position, fluid is supplied through a conduit 4 for closing the blowout preventer. Thus, when the blowout preventer is open, conduit 3 is pressurized and when the blowout preventer is closed, conduit 4 is pressurized.

For supplying operating air to the control valve 11, an operating valve 20 is provided, having its inlet connected to the air source or rig air, upstream of the control valve 11 through conduits 12, 13, and 14. At least one outlet of the valve 20 is connected to the control valve 11 through conduits 21, 22 and 23. It will also be noted that a manually operated three-way valve 30 is connected in these lines. This valve, referred to hereafter as an override valve 30, is optional. However, as will be more fully understood hereafter, it is an important feature. One inlet of the override valve 30 is also connected to rig air through conduits 12, 13, and 15.

Also connected to rig air through conduits 12, 13 and 16 is a pilot valve 40, the operation of which is controlled by hydraulic pressure supplied through conduit 41 connected to the hydraulic line 4 through which pressure is applied to the blowout preventers (BOP) when the blowout preventer is closed. At least one outlet of the pilot valve 40 is connected to the operating valve 20 through conduits 42 and 43. This outlet is normally not in fluid communication with the inlet of the pilot valve 40. However, the pilot valve 40 is responsive to closing pressure applied to the blowout preventer for placing the inlet and outlet in fluid communication to produce an air signal to the operating valve 20 for in turn supplying operating air to the control valve 11. Of course, when there is no closing pressure on the blowout preventer, the pilot valve 40 remains in a position in which the air received thereby is vented through a vent port 44.

To indicate the position of a blowout preventer, a visual annunciator 25 may be provided with the operating valve 20. For example, a green flag may indicate that the blowout preventer is open and a red flag, that it is closed. Annunciators 50 and 60 may also be connected to the air conduit 10 upstream and downstream of the control valve 11, respectively, via conduits 12, 13 and 17 (for annunciator 50) and 18 and 19 (for annunciator 60). These annunciators 50 and 60 indicate whether or not air is being supplied to the control valve 11 and the clutch controls of the drawworks, respectively.

Thus, in normal operation, when the blowout preventers are open, the control valve 11 is opened allowing rig air to be communicated to the clutch controls of the drawworks. However, if the blowout preventers are closed, the monitor on pilot valve 40 senses such, assumes a position communicating rig air with the operating valve 20 which in turn communicates operating air to the control valve 11 causing the control valve 11 to interrupt flow of air to the drawworks clutch controls and preventing inadvertent operation of the drawworks while the blowout preventers remain closed. However, as previously mentioned, these are cases when operation of the drawworks is desired even though the blowout preventers are closed, e.g. stripping the drill string out of the well while maintaining pressure control thereon. In such case, it is simply necessary to manipulate the override valve 30 so that conduits 15 and 22 are in fluid communication with each other. Then rig air flows through conduits 12, 13, 15, 22 and 23 directly to the control valve 11, bypassing operating valve 20.

A number of the components of the apparatus of the present invention may be conveniently assembled and placed in a housing 70 such as shown in FIG. 1 and as outlined in FIG. 2. Connectors 61, 62, 63, 64 and 65 allow field installation and connection to the respective conduits associated with the control valve 11 and the pilot valve 40. The various conduits connecting the components of the control apparatus, i.e. 12, 19, 23, 16, 42, may be sheathed in protective hoses 71 and 72. The annunciators 25, 50 and 60 are mounted in the housing 70 for visual observation. For example, annunciator 50 indicates whether the rig air is low or normal; annunciator 25 indicates whether the blowout preventer is closed or open and the annunciator 60 indicates whether the drawworks are disabled or enabled by air. In addition, a hand operated switch 73 is mounted on the housing 70 for operation of the override valve 30. Thus, the control apparatus may be neatly enclosed in the housing 70 requiring only installation of the control valve 11, pilot valve 40 and the connection of respective conduits.

Figure 3:
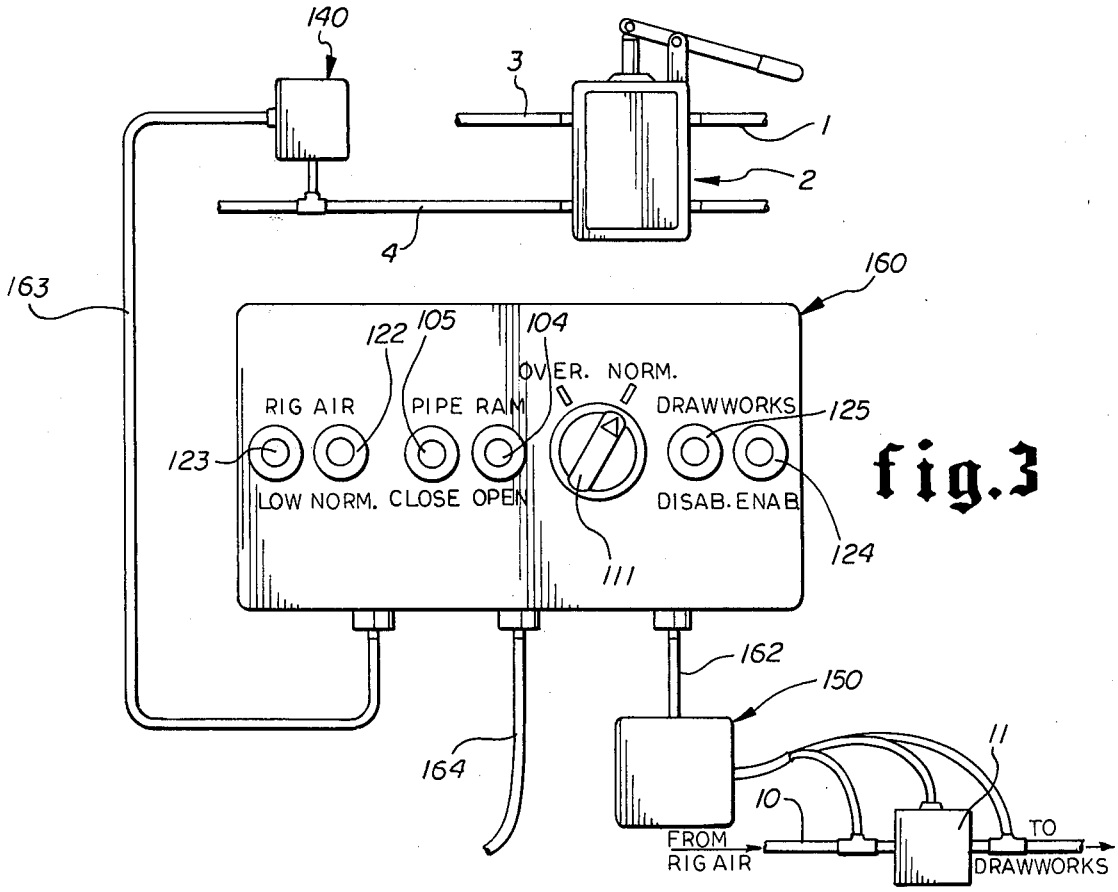
FIG. 3 is a pictorial illustration of an electrical version of the control apparatus of the present invention, according to a preferred embodiment thereof.
Figure 4:
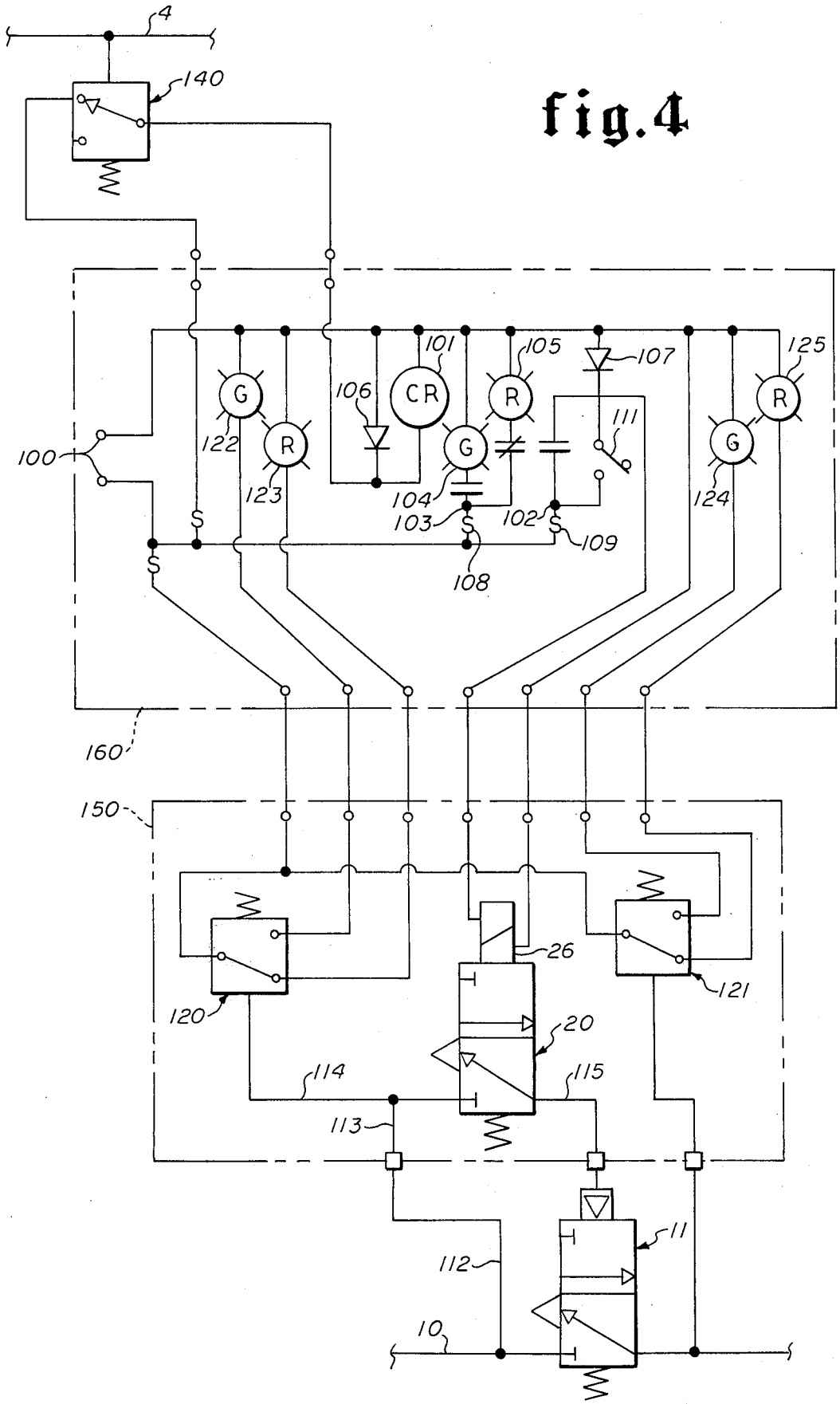
FIG. 4 is an electrical circuit diagram of the electrical version of FIG. 3.

Referring now to FIGS. 3 and 4, an electrical version of the control apparatus of the present invention will be described. Some of the components are essentially the same and will be so designated by using the same reference number as in the previous embodiment. For example, a similar control valve 11 may be installed in the air conduit 10 for operation by operating valve 20. The operating valve 20 is essentially the same as the operating valve 20 in the previous embodiment except that it is operated by a signal supplied to an electrical solenoid 26 rather than by an air signal. Air flows from the air conduit 10 through conduits 112, 113, and 114 to the operating valve 20 and when fluid communication is allowed through conduit 115 back to the control valve 11 for operation thereof.

Rather than the pilot valve of the pneumatic embodiment, the electrical version is provided with a pressure switch 140 which is connected to the hydraulic closing line 4 through which the blowout preventers are closed. The pressure switch 140 is normally closed receiving power through an electrical circuit which includes a source of electrical power connected to poles 100. Included in the monitor circuit is a control relay 101 which is normally energized through the closed pressure switch 140 (when the blowout preventers are open). One pole 102 of the control relay is connected to the solenoid 26 of operating valve 20 so that the solenoid 26 is energized, holding the operating valve 20 in the vented or opened position. Another pole 103 of the relay 101 is connected to indicator lights 104 and 105 so that when the blowout preventers are opened a green light 104 is lit and when the blowout preventers are closed, a red light 105 is lit. Suppression diodes 106 and 107 and fuses 108 and 109 may be provided in the relay circuit.

Upon closing of the blowout preventer, pressure is applied to the pressure switch 140 causing the switch to be opened and deenergizing the control relay 101. Power is thus interrupted to the solenoid 26 allowing the operating valve 20 to shift to the closed position communicating rig air with control valve 11 through conduit 115. The control valve 11 then assumes a closed or vented position, interrupting communication of rig air with the clutch controls of the drawworks, disablint the drawworks. If desired, an override switch 111 is connected in parallel with the second pole 102 of the relay 101 and upon closing of the override switch 111, power is supplied directly from the power source 100 to the solenoid 26 returning the operating valve 20 to the opened or vented position and allowing communication of air to the drawworks clutch controls, even though the blowout preventers are closed.

In addition to the annunciator lights 104 and 105 which show the position of the blowout preventer, annunciators are provided to indicate whether or not air is being supplied to the control valve 11 and the drawworks. In the present electrical version, these annunciators are provided by electrical pressure switches 120 and 121, the air inlets of which are connected to the air conduit 10 upstream and downstream of the control valve 11 respectively. The electrical poles of the annunciators 120 and 121 are connected to the power source 100 and annunciator lights 122, 123, 124, and 125. When rig air is low, the circuit to the red indicator light 123 is completed through switch 120. The rig air is normal, the circuit is completed through the switch 120 to the green light 122. When no air is being supplied to the clutch controls of the drawworks, the circuit is completed through switch 121 to the red light 125 and when air is being supplied to the drawworks clutch control, the circuit is completed through switch 121 to the green annunciator 124.

Thus, in the electrical version of the control apparatus of the present invention, rig air is supplied to the drawworks clutch controls through control valve 11 as long as the blowout preventers are opened. However, upon closing of the blowout preventer, the pressure responsive switch 140 generates a signal deenergizing control relay 101 and the connected solenoid 26 so that operating air is supplied to the control valve 11 causing control valve 11 to be vented or closed, interrupting air to the drawworks. If desired, the override switch 111 can be thrown to again supply air to the drawworks even though the blowout preventers are closed.

Referring now to FIG. 3, various components of the electrical version of the control apparatus of the present invention may be mounted in housing modules. One module 150 may enclose the air operated components, operating valve 20 and annunciator switches 120 and 121. Another housing 160 may enclose the electrical components. Interconnection between the modules or housings 150 and 160 may be through an armored cable 162 and interconnection between the electrical housing 160 and pressure switch 140 may be through an armored cable 163. Power is supplied through cable 164.

The annunciators 104, 105, 122, 123, 124, and 125 are mounted in the electrical housing 160 for easy viewing and for indicating the various monitored conditions. In addition, the override switch 111 is placed in the electrical housing 160 for ease of operation.

Thus, the control apparatus of the present invention includes control components for connection with rig air movable from a first mode, in which air is permitted to communicate with the drawworks through the air conduit, and a second mode, in which air is prevented from communicating with the drawworks. Monitored components are provided for sensing whether the blowout preventer is in the open or closed position and initiating movement of the control components to the second mode upon movement of the blowout preventer to the closed position. An override feature is also provided. The apparatus is extremely effective, relatively simple to install and service, and considering the risk involved in not having such apparatus, is extremely inexpensive.

The control apparatus of the present invention was specifically designed for use with a drilling rig. However, it can be used with a workover rig, snubber rig or any type of ring utilizing drawworks and blowout preventers. Thus, the term "drilling rig" as used herein is intended to include any rig, drawworks and blowout preventer combination.

While two versions of the control apparatus of the present invention, one pneumatic and the other electrical, have been described herein, many variations of the invention may be made without departing from the spirit of the invention. Accordingly, it is intended that the scope of the invention be limited only by the claims which follow.

I claim:

1. Control apparatus for preventing inadvertent operation of the drawworks of a drilling rig upon closure of an associated blowout preventer, the drawworks being at least partially operated by air from an air source connected thereto by an air conduit, said control apparatus comprising:

control means for connection to said air conduit and movable from a first mode, in which air is permitted to communicate with said drawworks through said air conduit, and a second mode, in which air is prevented from communicating with said drawworks; and monitor means for connection to said blowout preventer and said control means for sensing whether said blowout preventer is in opened or closed positions and initiating movement of said control means to said second mode upon movement of said blowout preventer to said closing position.

2. Control apparatus as set forth in claim 1 in which said control means comprises a first valve for connection in said air conduit and movable in response to said movement of said blowout preventer to said closed position, from an opened position corresponding with said first mode, to a closed position corresponding with said second mode and in which air flow through said air conduit is interrupted.

3. Control apparatus as set forth in claim 2 in which said control means comprises a second valve, the inlet of which is connected to said air conduit upstream of said first valve and having at least one outlet connected to said first valve, said second valve being connected to said monitor means and responsive to a signal therefrom upon movement of said blowout preventer to said closed position for introducing air to said first valve for operation thereof.

4. Control apparatus as set forth in claim 3 including override means connected to said second valve, operable independently of said monitor means, for introducing air to said first valve for operation thereof.

5. Control apparatus as set forth in claim 3 including annunciator means connected to said monitor means for indicating the position of said blowout preventers.

6. Control apparatus as set forth in claim 1 in which said monitor means includes a sensing device, responsive to closing pressure applied to said blowout preventer, for creating a signal to effect said initiating movement of said control means to said second mode upon movement of said blowout preventer to said closed position.

7. Control apparatus as set forth in claim 6 in which said sensing device is biased against response to said closing pressure, leaving said control means in said first mode unless said closing pressure is maintained on said blowout preventer.

8. Control apparatus as set forth in claim 1 including override means connected to said control means and operable independently of said monitor means for initiating movement of said control means to said second mode regardless of the position of said blowout preventer.

9. Control apparatus as set forth in claim 1 including annunciator means connected to said monitor means and said air conduit for indicating the position of said blowout preventer and whether or not air is being communicated to said drawworks.

10. Control apparatus for preventing inadvertent operation of the drawworks of a drilling rig upon closure of an associated blowout preventer, the drawworks being at least partially operated by air from an air source connected thereto by an air conduit, said control apparatus comprising:

an air operated control valve for connection in said conduit and movable, in response to air supplied thereto, from an open position, in which air is permitted to communicate with said drawworks through said air conduit, to a closed position, in which air is prevented from communicating with said drawworks;

an operating valve having its inlet connected to said air source upstream of said control valve and at least one outlet connected to said control valve for supplying operating air thereto upon receiving a signal indicating that said blowout preventer is in said closed position; and a pilot valve having an inlet connected to said air source upstream of said control valve and at least one outlet connected to said operating valve but normally not in fluid communication with said inlet, said pilot valve being responsive to closing pressure applied to said blowout preventer for placing said pilot valve inlet and outlet in fluid communication producing said signal to said operating valve for supplying operating air to said control valve.

11. Control apparatus as set forth in claim 10 including an override valve at least one inlet of which is connected to said air source upstream of said control valve and the outlet of which is connected to said control valve, said override valve being operable independently of said pilot valve for supplying operating air to said control valve regardless of the position of said blowout preventer.

12. Control apparatus as set forth in claim 11 in which said override valve includes another inlet to which said one outlet of said operating valve is connected and through which said operating air is supplied to said control valve upon said receipt of said signal indicating that said blowout preventer is in said closed position.

13. Control apparatus as set forth in claim 10 in which said pilot valve is provided with a vent port through which air entering said pilot valve through said inlet is vented when opening pressure is applied to said blowout preventer preventing said signal from being received by said operating valve.

14. Control apparatus as set forth in claim 10 in which said operating valve is provided with a vent port through which air entering said operating valve through said inlet is vented, except when said signal is being received from said pilot valve, preventing said operating air from being supplied to said control valve.

15. Control apparatus as set forth in claim 10 in which said control valve is provided with a vent port through which air entering said control valve from said air conduit is vented when said control valve is in said closed position.

16. Control apparatus as set forth in claim 10 in which said operating valve includes pressure responsive annunciator means for indicating whether said blowout preventer is in the opened or closed position.

17. Control apparatus as set forth in claim 16 including second and third pressure responsive annunciator means connected to said air conduit upstream and downstream of said control valve, respectively, for indicating whether or not air is being supplied to said control valve and said drawworks, respectively.

18. Control apparatus as set forth in claim 10 including annunciator means connected to said air conduit upstream and downstream of said control valve for indicating whether or not air is being supplied to said control valve and said drawworks.

19. Control apparatus for preventing inadvertent operation of the drawworks of a drilling rig upon closure of an associated blowout preventer, the drawworks being at least partially operated by air from an air source connected thereto by an air conduit, said control apparatus comprising:

an air operated control valve for connection in said conduit and movable in response to air supplied thereto, from an open position, in which air is permitted to communicate with said drawworks through said air conduit, to a closed position, in which air is prevented from communicating with said drawworks;

an electrically operated operating valve having its inlet connected to said air source upstream of said control valve and at least one outlet connected to said control valve for supplying operating air thereto upon receiving an electrical signal indicating that said blowout preventer is in said closed position; and an electrical monitor circuit connected to said operating valve and responsive to closing pressure applied to said blowout preventer for providing said electrical signal to said operating valve.

20. Control apparatus as set forth in claim 19 in which said operating valve is provided with a vent port through which air entering said operating valve through said inlet is vented, except when said signal is being received from said monitor circuit, preventing said operating air from being supplied to said control valve.

21. Control apparatus as set forth in claim 19 in which said control valve is provided with a vent port through which air entering said control valve from said air conduit is vented when said control valve is in said closed position.

22. Control apparatus as set forth in claim 19 including annunciator means connected to said air conduit upstream and downstream of said control valve for indicating whether or not air is being supplied to said control valve and said drawworks.

23. Control apparatus as set forth in claim 22 in which said annunciator means includes first and second electrical switches, responsive to air pressure upstream and downstream of said control valve, respectively, for producing electrical signals for said indicating whether or not air is being supplied to said control valve and said drawworks.

24. Control apparatus as set forth in claim 19 in which said monitor circuit includes a source of electrical power, connected to said electrically operated operating valve, and a switch in said monitor circuit operable in response to said closing pressure applied to said blowout preventer for providing said electrical signal to said operating valve.

25. Control apparatus as set forth in claim 24 in which said monitor circuit includes an override switch operable independently of said pressure responsive switch for providing said electrical signal to said operating valve regardless of the position of said blowout preventer.

26. Control apparatus as set forth in claim 24 in which said monitor circuit includes an electrical relay, normally energized when said blowout preventer is in an open position but deenergized upon said closure of said blowout preventer and operation of said pressure responsive switch to produce said electrical signal to said operating valve.

27. Control apparatus as set forth in claim 26 in which said electrical relay includes two poles the first of which is connected to indicator means for indicating whether said blowout preventer is opened or closed and through the second of which said electrically operated valve is energized when said blowout preventer is opened and deenergized when said blowout preventer is closed.

28. Control apparatus as set forth in claim 27 including an override switch in parallel with said second pole and operable independently of said pressure responsive switch for energizing said electrically operated valve when said second pole is in a deenergized position.

29. Control apparatus as set forth in claim 27 in which said monitor circuit includes first and second annunciator means connected to first and second pressure responsive switches connected to said air conduit upstream and downstream, respectively, of said control valve for indicating whether or not air is being supplied to said control valve and said drawworks, respectively.

30. Control apparatus as set forth in claim 24 in which said monitor circuit includes first and second annunciator means connected to first and second pressure responsive switches connected to said air conduit upstream and downstream, respectively, of said control valve for indicating whether or not air is being supplied to said control valve and said drawworks, respectively.

* * * * *